US009847570B2

(12) United States Patent
Georgakopoulos et al.

(10) Patent No.: US 9,847,570 B2
(45) Date of Patent: Dec. 19, 2017

(54) MORPHING ORIGAMI MULTI-FUNCTIONAL AND RECONFIGURABLE ANTENNAS

(71) Applicant: Florida International University Board of Trustees, Miami, FL (US)

(72) Inventors: Stavros Georgakopoulos, Boca Raton, FL (US); Shun Yao, Miami, FL (US)

(73) Assignee: The Florida International University Board of Trustees, Miami, FL (US)

( * ) Notice: Subject to any disclaimer, the term of this patent is extended or adjusted under 35 U.S.C. 154(b) by 15 days.

(21) Appl. No.: 14/803,376

(22) Filed: Jul. 20, 2015

(65) Prior Publication Data

US 2017/0025748 A1 Jan. 26, 2017

(51) Int. Cl.

| | |
|---|---|
| ***H01Q 9/27*** | (2006.01) |
| ***H01Q 1/36*** | (2006.01) |
| ***H01Q 1/08*** | (2006.01) |
| *H01Q 11/08* | (2006.01) |
| *H01Q 9/18* | (2006.01) |
| *H01Q 9/20* | (2006.01) |
| *H01Q 9/16* | (2006.01) |

(52) U.S. Cl.

CPC ..... *H01Q 1/36* (2013.01); *H01Q 1/08* (2013.01); *H01Q 9/16* (2013.01); *H01Q 9/18* (2013.01); *H01Q 9/20* (2013.01); *H01Q 11/08* (2013.01); *H01Q 11/083* (2013.01); *H01Q 11/086* (2013.01)

(58) Field of Classification Search

CPC .... H01Q 11/08; H01Q 11/083; H01Q 11/086; H01Q 1/36; H01Q 1/38; H01Q 1/362; H01Q 9/27

USPC ..... 343/895, 796

See application file for complete search history.

(56) References Cited

U.S. PATENT DOCUMENTS

| | | | | |
|---|---|---|---|---|
| 3,781,898 | A * | 12/1973 | Holloway | H01Q 1/38 343/872 |
| 5,313,216 | A * | 5/1994 | Wang | H01Q 9/27 343/700 MS |
| 6,670,922 | B1 * | 12/2003 | Huang | H01Q 1/36 343/700 MS |
| 2006/0043199 | A1 * | 3/2006 | Baba | G06K 19/07749 235/492 |
| 2009/0046022 | A1 * | 2/2009 | Desclos | H01Q 1/362 343/702 |
| 2010/0289716 | A1 * | 11/2010 | Lenzi | H01Q 1/22 343/793 |

(Continued)

OTHER PUBLICATIONS

Foldable Printed Circuit Boards on Paper Substrates, by Siegel et al.*

(Continued)

*Primary Examiner* — Hoang Nguyen
*Assistant Examiner* — Awat Salih
(74) *Attorney, Agent, or Firm* — Saliwanchik, Lloyd & Eisenschenk

(57) ABSTRACT

Novel and advantageous antennas are provided. A multi-functional antenna can morph in order to change geometrical shape and thereby change its antenna radiation characteristics. Such characteristics can include radiation pattern, bandwidth, beamwidth, operational frequency, and directivity. The antenna can therefore be multifunctional such that one single antenna can serve multiple applications.

20 Claims, 11 Drawing Sheets

(56) References Cited

U.S. PATENT DOCUMENTS

2013/0194159 A1* 8/2013 Alexopoulos ..... H01Q 1/38 343/895
2014/0340275 A1* 11/2014 Georgakopoulos ..... H01Q 1/36 343/834

OTHER PUBLICATIONS

Analysis of Printed Archimedean and Single Ended Bifilar Spirals for Wireless Applications, by Yeoh.*
Hybrid Equi-angular to Archimedean Spiral Antenna, by Louertani et al.*
Investigations on a Novel Modified Archimedean Spiral Antenna,by Shanmugam et al.*
Georgakopoulos, Stavros, "Morphing Origami Multi-Functional & Reconfigurable Antennas," PowerPoint presentation.
Liu, Xueli et al. "Reconfigurable Helical Antenna Based on an Origami Structure for Wireless Communication System," *IEEE International Microwave Symposium*, Tampa Bay, FL, Jun. 1-6, 2014.
Nojima, Taketoshi. et al. "Origami Modeling of Functional Structures based on Organic Patterns," Kyoto University.
Yao, Shun et al. "A Mode Reconfigurable Nojima Origami Antenna," IEEE International Symposium on Antennas and Propagation and North American Radio Science Meeting, Vancouver, BC, Canada, Jul. 19-24, 2015.
Yao, Shun et al. "A Novel Reconfigurable Origami Accordion Antenna," *IEEE International Microwave Symposium*, Tampa Bay, FL, Jun. 1-6, 2014.
Yao, Shun et al. "A Novel Reconfigurable Origami Spring Antenna," *IEEE International Symposium on Antennas and Propagation*, pp. 374-375, TN, Jul. 6-11, 2014.
Yao, Shun et al. "A Novel Tunable Origami Accordion Antenna," *IEEE International Symposium on Antennas and Propagation*, pp. 370-371, TN, Jul. 6-11, 2014.

* cited by examiner

MORPHING ORIGAMI MULTI-FUNCTIONAL AND RECONFIGURABLE ANTENNAS

GOVERNMENT SUPPORT

This invention was made with government support under grant number EFRI 1332348 awarded by the National Science Foundation. The government has certain rights in the invention.

BACKGROUND

Antennas are used in nearly all wireless communication systems. Depending on the application, a wireless communication system may benefit from a certain type of antenna. Existing antennas typically cover a single frequency band and/or serve a single purpose. Antennas also tend to take up a large amount of volume if the range is large.

BRIEF SUMMARY

Novel and advantageous antennas are provided, as well as methods for fabricating the same and methods of using the same. A multi-functional antenna can morph in order to change geometrical shape and thereby change its antenna radiation characteristics. Such characteristics can include, e.g., radiation pattern, bandwidth, beamwidth, and directivity. The antenna can therefore be multifunctional such that one single antenna can serve multiple applications and/or have multiple operating frequencies.

In an embodiment, an antenna can include: a substrate having a central hub and folding markings provided on the substrate outside the central hub; and at least one metal line disposed on the substrate. The antenna can have an unfolded state and a folded state resulting from folding the substrate based on the folding markings. At least one radiation characteristic of the antenna is different in the folded state than it is in the unfolded state, and the at least one radiation characteristic can be radiation pattern, bandwidth, beamwidth, operating frequency, or directivity.

In another embodiment, a method of using an antenna for wireless communication can include: providing an antenna as described herein; using the antenna for its intended purpose; and changing the state of the antenna from the folded state to the unfolded state, or from the unfolded state to the folded state, such that the at least one radiation characteristic of the antenna changes.

In yet another embodiment, a method of fabricating an antenna can include: forming a substrate; providing a central hub on the substrate; providing folding markings outside the central hub on the substrate; and disposing at least one metal line on the substrate.

DETAILED DESCRIPTION

Figure 1A:
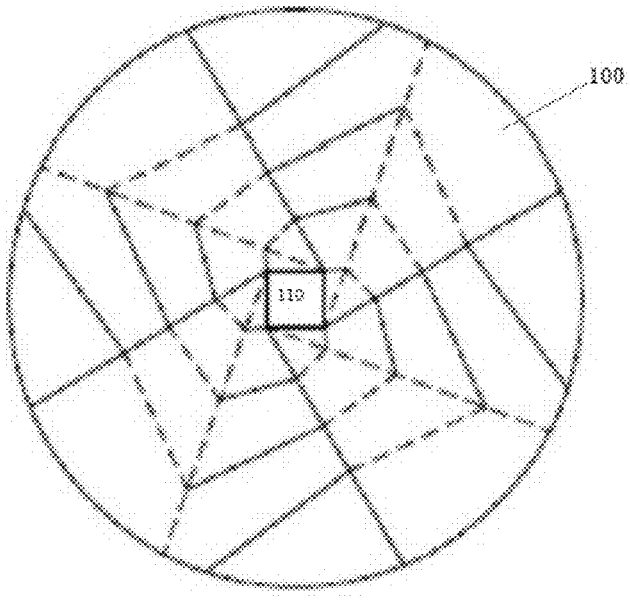
FIG. 1A shows a substrate with markings according to an embodiment of the subject invention.

Novel and advantageous antennas are provided, as well as methods for fabricating the same and methods of using the same. A multi-functional antenna can morph in order to change geometrical shape and thereby change its antenna radiation characteristics. Such characteristics can include, e.g., radiation pattern, bandwidth, beamwidth, and directivity. The antenna can therefore be multifunctional such that one single antenna can serve multiple applications and/or have multiple operating frequencies.

Antennas that can cover multiple frequency bands and/or serve different purposes are highly beneficial for wireless communication systems. Origami reconfigurable antennas can be multi-functional and reduce payload costs while decreasing volume. The Nojima wrapping origami structure [5] can be used to establish low-cost, deployable, aerospace structures. The subject invention can include various kinds of Nojima wrapping models designed by using different central hub shapes and different angles between segments (i.e., folding markings).

In many embodiments, an antenna can be a morphing origami antenna. The antenna can have an unfolded state and one or more folded states (e.g., a completely folded state, one or more intermediate folded states between the unfolded state and the completely folded state). The antenna can include a substrate and at least one metal line or metal layer on the substrate. The substrate can have markings for folding (i.e., folding markings) that can be used for folding the antenna into its folded state(s), though embodiments are not limited thereto (e.g., the substrate may omit the folding markings and the antenna can be folded to give a folded state based on, for example, knowledge of the folder). The substrate can further have a central hub that is not folded during the folding process. That is, the central hub can be void of any folding markings (if present on the substrate) and can remain in its same shape when the antenna is in the folded state(s). At least one radiation characteristic of the antenna can be different in its folded state (e.g., completely folded state, or an intermediate folded state between the unfolded state and the completely folded state) than it is in its unfolded state. The radiation characteristics can include, but are not necessarily limited to, radiation pattern, bandwidth, beamwidth, operating frequency, and directivity of the antenna. The antenna can therefore advantageously provide multi-functionality, such that one antenna can serve multiple applications and/or have multiple operating frequencies. In some embodiments, multiple or even all radiation characteristics of the antenna can be different in a folded state (e.g., completely folded state, or an intermediate folded state between the unfolded state and the completely folded state) than they are in its unfolded state.

The substrate of the antenna can be any material suitable for folding and having metal material deposited thereon. For example, the substrate can be a paper, cardboard, or Kapton® (polyimide film) material. In many embodiments, the substrate can have a circular shape. In alternative embodiments, the substrate can have a polygon shape, an oval shape, or an irregular shape.

In many embodiments, the central hub of the substrate can be a geometric shape. For example, the central hub can be a polygon, such as a triangle, square, pentagon, hexagon, heptagon, octagon, nonagon, or decagon, though embodiments are not limited thereto.

Any number of metal lines or metal layers can be disposed on the substrate. For example, the antenna can include one, two, three, four, five, six, seven, eight, nine, ten, or more metal lines or layers. Each metal line or metal layer can be formed of any suitable material known in the art. Each metal line or layer can be formed of the same material or different materials. In some embodiments, some of the lines can be formed of the same material while others are formed of different materials. In many embodiments, each of the metal lines or layers can be separated from each other such that they are not physically touching. The metal lines or layers can be joined by another structure, though embodiments are not limited thereto. Such another structure can be insulating or conductive, depending on the application.

FIG. 1A shows a substrate 100 with folding markings thereon for an antenna according to an embodiment of the subject invention. Referring to FIG. 1A, the central hub 110 can be a square, and folding markings branch away from the central hub. Solid folding markings can represent mountain-style folds (folds such that both sides of the marking would be pushed into the page as depicted in FIG. 1A), and dashed folding markings can represent valley-style folds (folds such that both sides of the marking would be pulled out of the page as depicted in FIG. 1A). The folding markings can extend away from corners of the central hub. Folding markings can extend towards the edge of the substrate 100, and some can go all the way to the edge, though embodiments are not limited thereto. Folding markings can also go around the central hub 110, from an existing folding marking to an adjacent folding marking. The folding markings can be, e.g., Archimedean-type spiral creases.

Figure 1B:
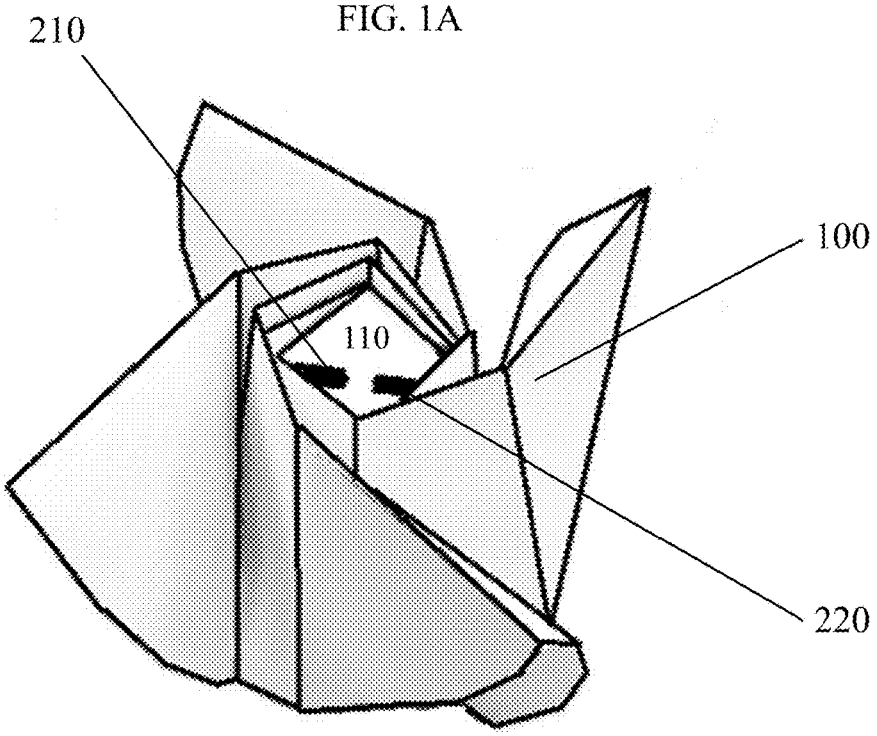
FIG. 1B shows a folded-state antenna structure according to an embodiment of the subject invention.
Figure 2:
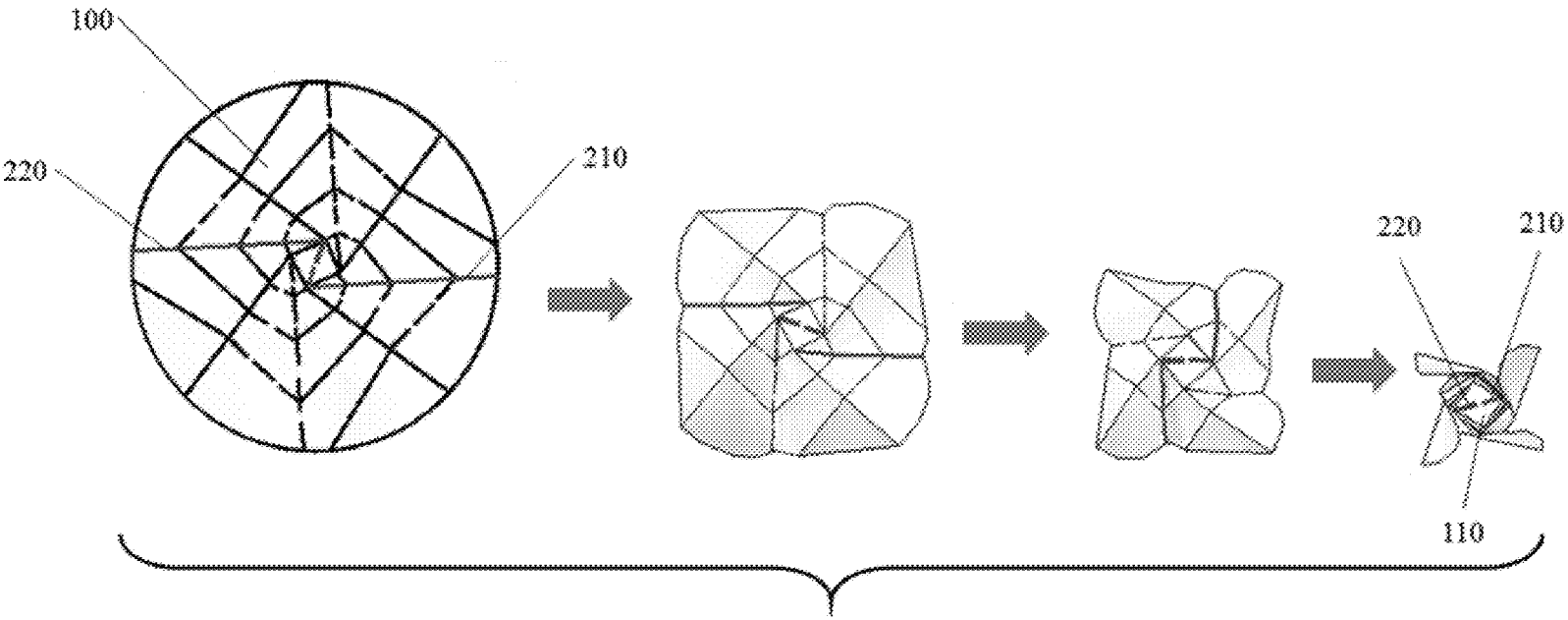
FIG. 2 shows a folding scheme for a folded-state antenna according to an embodiment of the subject invention.

FIG. 2 shows a folding procedure for the substrate of FIG. 1A. The left-most image of FIG. 2 includes a first metal line 210 (red line in FIG. 2) and a second metal line 220 (blue line in FIG. 2) disposed on the substrate 100. The second image shows the substrate 100 after some of the folds. The first metal line 210 is the lateral line on the left-hand section of the substrate 100 as depicted in this image and as the right-most line in the central hub, while the second metal line 220 is the lateral line on the right-hand section of the substrate 100 as depicted in this second image and as the left-most line in the central hub. The third image shows the substrate 100 after additional folds. The first metal line 210 is the vertical line to the left and below the central hub as depicted in this image and as the right-most line in the central hub, while the second metal line 220 is the vertical line above and to the right of the central hub as depicted in this second image and as the left-most line in the central hub. The fourth image shows the antenna in its completely folded state (i.e., after all of the folds have been performed on the substrate 100—in this case, based on the folding markings). The first second line 210 is the right-most line in the central hub as depicted in this image, and the second metal line 220 is the left-most line in the central hub as depicted in this image. FIG. 1B shows a larger version of the right-most image of FIG. 2 from a slightly different viewing angle.

Figure 1C:
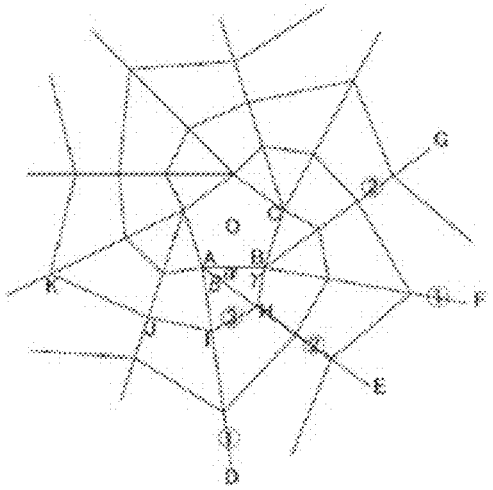
FIG. 1C shows a folding pattern according to an embodiment of the subject invention.
Figure 1D:
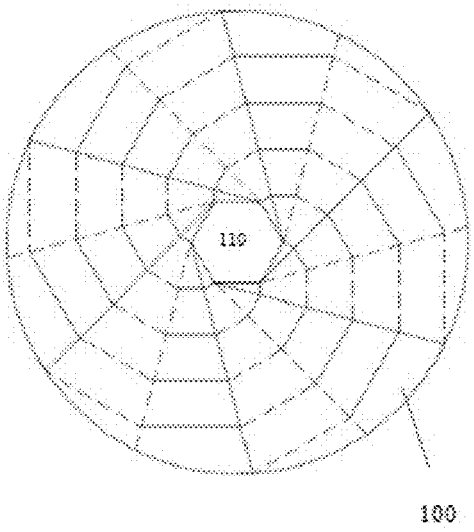
FIG. 1D shows a substrate with markings according to an embodiment of the subject invention.
Figure 1E:
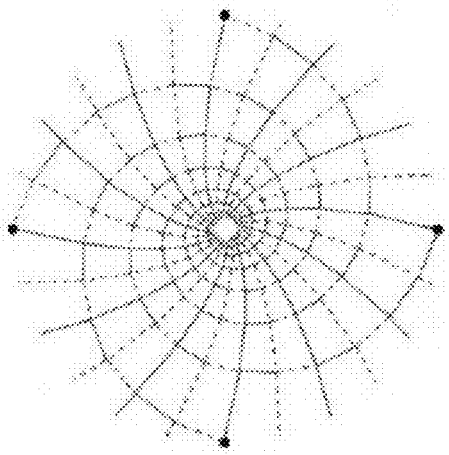
FIG. 1E shows a folding pattern according to an embodiment of the subject invention.

FIGS. 1C and 1E show further examples of folding markings and central hubs that can be used on substrates according to various embodiments of the subject invention. FIG. 1C shows a pentagon central hub, and FIG. 1E shows a square central hub. Solid folding markings in FIG. 1E can represent mountain-style folds, and dashed folding markings can represent valley-style folds. FIG. 1C marks some of the angles that can be changed to result in different folded-state designs ($\alpha$, $\beta$, and $\gamma$).

Figure 1F:
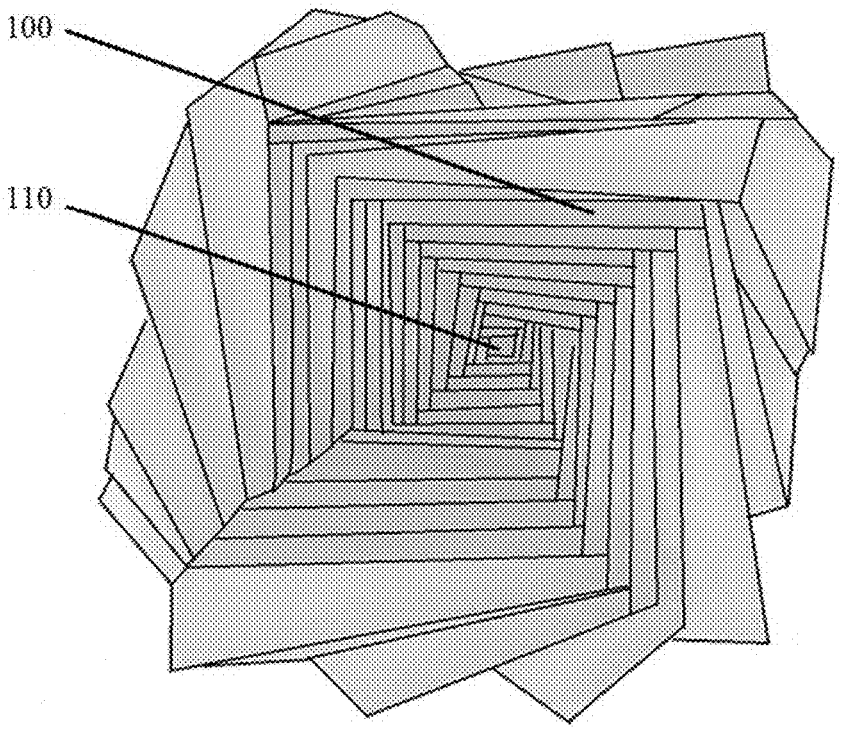
FIG. 1F shows a folded substrate according to an embodiment of the subject invention.
Figure 1G:
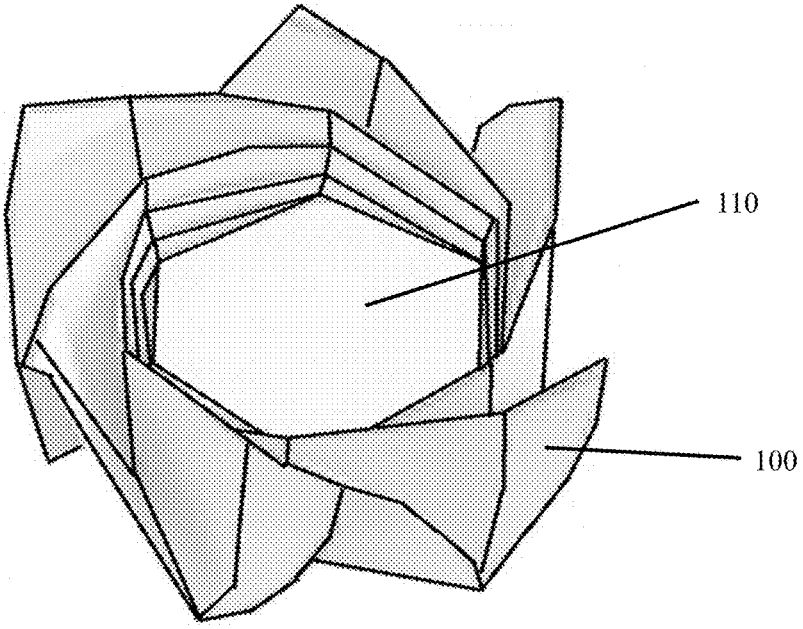
FIG. 1G shows a folded substrate according to an embodiment of the subject invention.

FIG. 1D shows another example of a substrate 100 with folding markings thereon. Referring to FIG. 1D, the central hub 110 is a hexagon, and folding markings branch away from corners of the hexagonal central hub. Solid folding markings can represent mountain-style folds, and dashed folding markings can represent valley-style folds. FIG. 1G shows a schematic view of the substrate of FIG. 1D in its folded-state (based on the folding). Referring to FIG. 1G, the central hub 110 of the substrate 100 retains its shape and has not been folded. FIG. 1F shows a substrate in a completely folded state, after folding based on the folding markings shown in FIG. 1E.

Figure 8B:
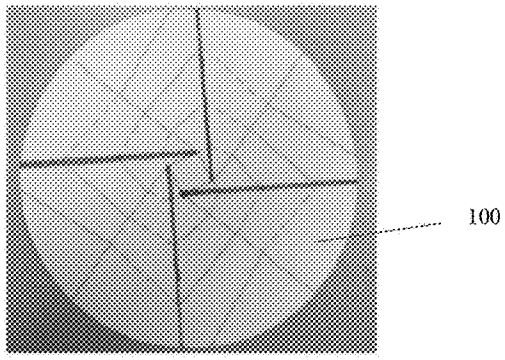
FIG. 8B shows an antenna in an unfolded state according to an embodiment of the subject invention.
Figure 8D:
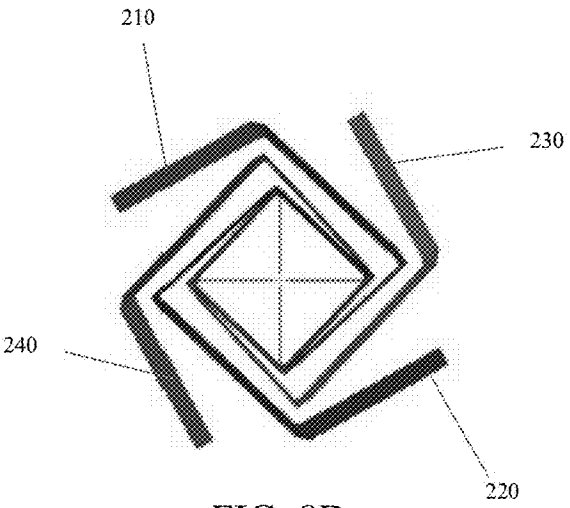
FIG. 8D shows a top view of metal lines of a folded-state antenna according to an embodiment of the subject invention.
Figure 8A:
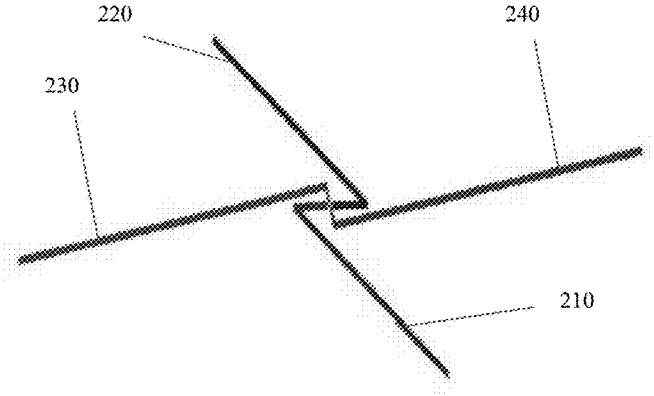
FIG. 8A shows a top view of metal lines of an unfolded-state antenna according to an embodiment of the subject invention.
Figure 8C:
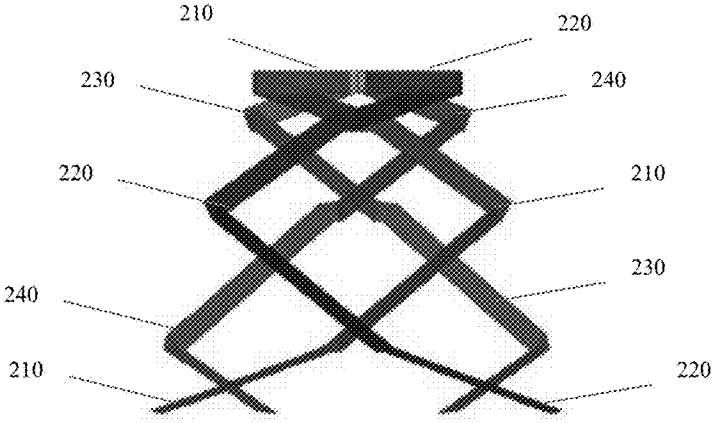
FIG. 8C shows a side view of metal lines of a folded-state antenna according to an embodiment of the subject invention.

FIG. 8B shows an antenna in an unfolded state according to an embodiment of the subject invention, and FIG. 8A shows a top view of the four metal lines disposed on the substrate 100 of the antenna in FIG. 8B. FIGS. 8C and 8D show a side view and a top view, respectively, of the metal lines in the completely folded state. Referring to FIGS. 8A-8D, a first metal line 210 (red line in FIGS. 8A-8D), a second metal line 220 (blue line in FIGS. 8A-8D), a third metal line 230 (green line in FIG. 8A-8D), and a fourth metal line (brown line in FIGS. 8A-8D) can be disposed on the substrate 100. The folding markings and central hub of the substrate 100 depicted in FIG. 8B are the same as those depicted in FIG. 1A. After folding, the metal lines 210, 220, 230, 240 can be in a completely different configuration (FIGS. 8C and 8D) compared to before folding (FIGS. 8A and 8B). Though FIGS. 8A-8D depict four metal lines on a substrate as shown in FIG. 1A, this is for demonstrative purposes only; as described herein, any number of metal lines can be used on any substrate.

Figure 9A:
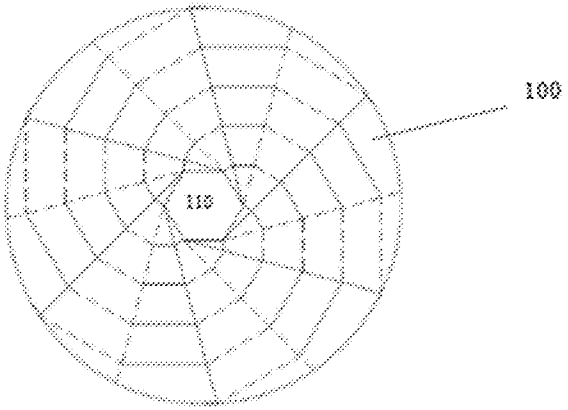
FIG. 9A shows a substrate with markings according to an embodiment of the subject invention.
Figure 9B:
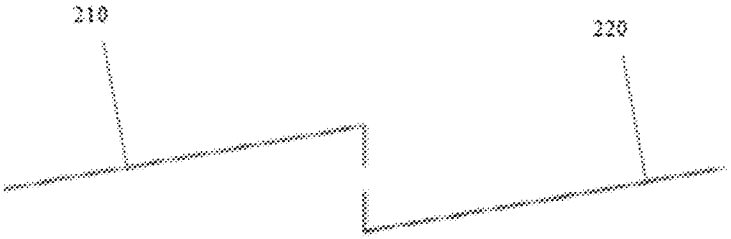
FIG. 9B shows a top view of metal lines of an unfolded-state antenna according to an embodiment of the subject invention.
Figure 9C:
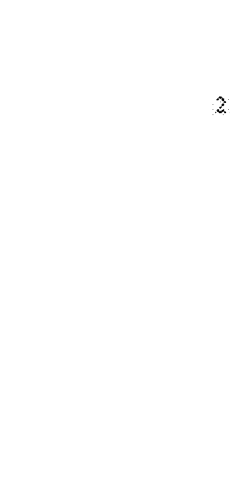
FIG. 9C shows a top view of metal lines of a folded-state antenna according to an embodiment of the subject invention.
Figure 9D:
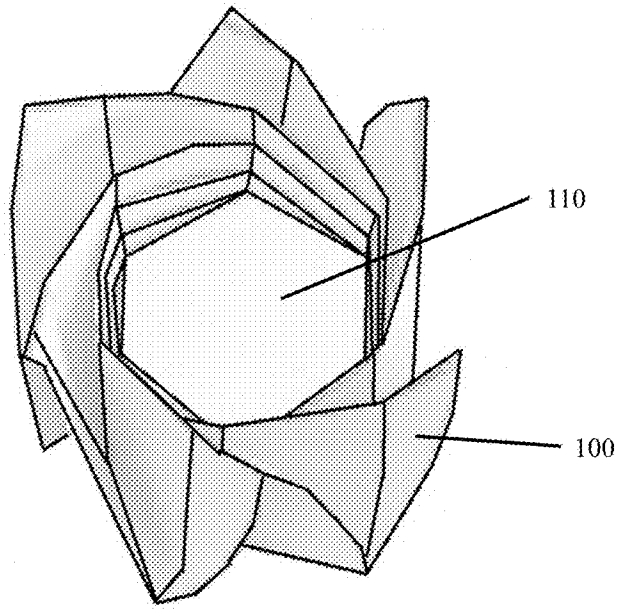
FIG. 9D shows a folded substrate according to an embodiment of the subject invention.

FIG. 9A shows a substrate 100 with folding markings thereon for an antenna according to an embodiment of the subject invention. Referring to FIG. 9A, the central hub 110 is a hexagon, and folding markings branch away from the central hub. Solid folding markings can represent mountain-style folds, and dashed folding markings can represent valley-style folds. The folding markings can extend away from corners of the central hub. Folding markings can extend towards the edge of the substrate 100, and some can go all the way to the edge, though embodiments are not limited thereto. Folding markings can also go around the central hub 110, from an existing folding marking to an adjacent folding marking FIG. 9D shows the substrate of FIG. 9A in its completely folded state (based on the folding markings). Referring to FIG. 9D, the central hub 110 of the substrate 100 retains its shape and has not been folded. FIG. 9B shows first 210 and second 220 metal lines that can be disposed on a substrate according to embodiments of the subject invention. FIG. 9C shows a top view of the first 210 and second 220 metal lines of FIG. 9B in the completely folded state after being deposited on the substrate 100 of FIG. 9A (and then the substrate 100 is folded based on the folding markings).

Antennas according to embodiments of the subject invention can advantageously have multiple operational frequencies (e.g., one in a completely folded state, and a different one in an unfolded state, and possibly others in intermediate folded states) and/or directional modes (e.g., one in a completely folded state, and a different one in an unfolded state, and possibly others in intermediate folded states). In many embodiments, at least one radiation characteristic of the antenna can be different in its folded state (e.g., completely folded or intermediate folded) than it is in its unfolded state. The radiation characteristics can include, but are not necessarily limited to, radiation pattern, bandwidth, beamwidth, operating frequency, and directivity of the antenna. The antenna can therefore advantageously provide multi-functionality, such that one antenna can serve multiple applications and/or have multiple operating frequencies. In some embodiments, multiple or even all radiation characteristics of the antenna can be different in its folded state than they are in its unfolded state.

Antennas according to embodiments of the subject invention can be multi-mode (e.g., two-mode or more) and can be reconfigurable. For example, the antenna can be one mode in a folded state and can be a different mode in an unfolded state (e.g., directional mode in a folded state and omnidirectional in an unfolded state). The operational frequency of the antenna can be different from the folded state to the unfolded state. In many embodiments, the antenna can be a multi-mode (e.g., two-mode) reconfigurable origami Nojima antenna.

Antennas of the subject invention can be useful for many applications, including space-borne and airborne applications. The antennas are also very well-suited as tactical antennas, field antennas, and portable antennas.

In an embodiment, a method of fabricating an antenna can include forming a substrate, providing folding markings on the substrate, and disposing at least one metal line on the substrate. The substrate can be as described herein, such that the folding markings and central hub can be as described herein.

In a further embodiment, a method of using an antenna for wireless communication can include providing an antenna as described herein, and using the antenna for its intended purpose. The method can further include folding and/or unfolding the antenna to change states such that at least one radiation characteristic of the antenna changes (e.g., from its folded state, which can be completely folded or intermediate folded, to its unfolded state). The radiation characteristics can include, but are not necessarily limited to, radiation pattern, bandwidth, beamwidth, operating frequency, and directivity of the antenna.

The subject invention includes, but is not limited to, the following exemplified embodiments.

Embodiment 1

An antenna, comprising:

a substrate having a central hub and folding markings provided on the substrate outside the central hub; and at least one metal line disposed on the substrate, wherein the antenna has an unfolded state and a folded state (e.g., completely folded state, or an intermediate folded state between the unfolded state and the completely folded state) resulting from folding the substrate based on the folding markings, wherein at least one radiation characteristic of the antenna is different in the folded state than it is in the unfolded state, wherein the at least one radiation characteristic is radiation pattern, bandwidth, beamwidth, operating frequency, or directivity.

Embodiment 2

The antenna according to embodiment 1, wherein the at least one radiation characteristic includes at least one of operating frequency and directivity.

Embodiment 3

The antenna according to any of embodiments 1-2, wherein at least two radiation characteristics of the antenna are different in the folded state than they are in the unfolded state.

Embodiment 4

The antenna according to any of embodiments 1-2, wherein at least three radiation characteristics of the antenna are different in the folded state than they are in the unfolded state.

Embodiment 5

The antenna according to any of embodiments 1-2, wherein at least four radiation characteristics of the antenna are different in the folded state than they are in the unfolded state.

Embodiment 6

The antenna according to any of embodiments 1-2, wherein the radiation pattern, bandwidth, beamwidth, operating frequency, and directivity of the antenna are all different in the folded state than they are in the unfolded state.

Embodiment 7

The antenna according to any of embodiments 1-6, comprising at least two metal lines disposed on the substrate.

Embodiment 8

The antenna according to any of embodiments 1-6, comprising at least three metal lines disposed on the substrate.

Embodiment 9

The antenna according to any of embodiments 1-6, comprising at least four metal lines disposed on the substrate.

Embodiment 10

The antenna according to any of embodiments 1-9, wherein the substrate comprises at least one of a paper material, a cardboard material, or Kapton® (polyimide film).

Embodiment 11

The antenna according to any of embodiments 1-9, wherein the substrate is paper, cardboard, or Kapton®.

Embodiment 12

The antenna according to any of embodiments 1-11, wherein the substrate is circular.

Embodiment 13

The antenna according to any of embodiments 1-11, wherein the substrate has a polygon shape, an oval shape, or an irregular shape.

Embodiment 14

The antenna according to any of embodiments 1-13, wherein the central hub of the substrate has a polygon shape.

Embodiment 15

The antenna according to any of embodiments 1-14, wherein the central hub of the substrate has a square shape.

Embodiment 16

The antenna according to any of embodiments 1-14, wherein the central hub of the substrate has a hexagonal shape.

Embodiment 17

The antenna according to any of embodiments 1-16, comprising at least two metal lines, wherein the metal lines are separated from each other such that they are not in direct, physical contact with each other.

Embodiment 18

The antenna according to any of embodiments 1-16, comprising at least two metal lines, wherein the metal lines are in direct, physical contact with each other.

Embodiment 19

The antenna according to any of embodiments 1-18, wherein the folding markings are Archimedean-type spiral lines.

Embodiment 20

The antenna according to any of embodiments 1-19, wherein the folding markings include solid lines intended for mountain-style folds and dashed lines intended for valley-style folds.

Embodiment 21

The antenna according to any of embodiments 1-20, wherein the folding markings include lines extending away from respective corners of the central hub.

Embodiment 22

The antenna according to embodiment 21, wherein each line extending away from a respective corner of the central hub extends towards a respective edge of the substrate.

Embodiment 23

The antenna according to any of embodiments 1-22, wherein the folding markings include lines around the central hub.

Embodiment 24

The antenna according to any of embodiments 1-23, wherein the folded state is a completely folded state.

Embodiment 25

The antenna according to any of embodiments 1-23, wherein the folded state is an intermediate folded state between the completely folded state and the unfolded state.

Embodiment 26

A method of using an antenna for wireless communication, the method comprising:

providing the antenna according to any of embodiments 1-25; and using the antenna for its intended purpose.

Embodiment 27

The method according to embodiment 26, further comprising:

changing the state of the antenna from the folded state to the unfolded state, or from the unfolded state to the folded state, such that the at least one (or two, or three, or four, or five) radiation characteristic(s) of the antenna changes.

Embodiment 28

A method of fabricating an antenna, the method comprising:

forming a substrate;

providing a central hub on the substrate;

providing folding markings outside the central hub on the substrate; and disposing at least one metal line on the substrate.

Embodiment 29

The method according to embodiment 28, wherein the substrate is the substrate as described in any of embodiments 1-25.

Embodiment 30

The method according to embodiment 28, wherein the folding markings are the folding markings as described in any of embodiments 1-25.

Embodiment 29

The method according to embodiment 28, wherein the central hub is the central hub as described in any of embodiments 1-25.

Embodiment 30

The method according to embodiment 28, wherein the at least one metal line is the at least one metal line as described in any of embodiments 1-25.

A greater understanding of the present invention and of its many advantages may be had from the following examples, given by way of illustration. The following examples are illustrative of some of the methods, applications, embodiments and variants of the present invention. They are, of course, not to be considered as limiting the invention. Numerous changes and modifications can be made with respect to the invention.

Example 1

Figure 3B:
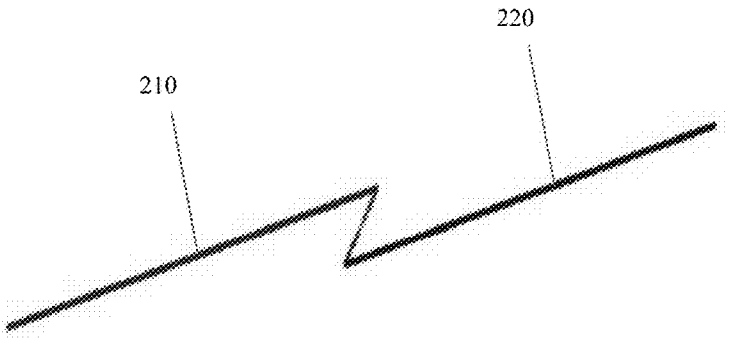
FIG. 3B shows a top view of metal lines of an unfolded-state antenna according to an embodiment of the subject invention.
Figure 3A:
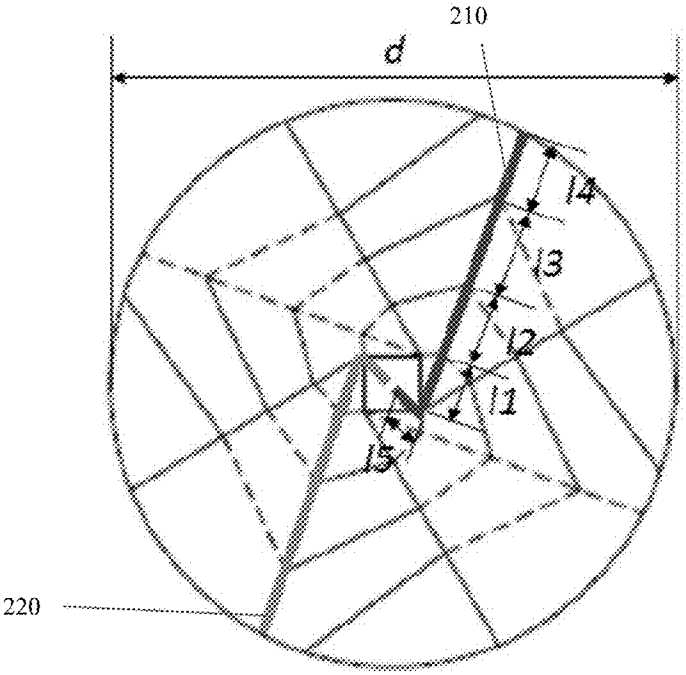
FIG. 3A shows an antenna in an unfolded state according to an embodiment of the subject invention.

An antenna was fabricated and tested. The antenna used a paper substrate with markings as shown in FIG. 1A. FIG. 3B shows a top view of the two metal lines used, and FIG. 3A shows the antenna, with the metal lines, in its unfolded state. FIG. 2 illustrates the folding procedure used, and FIG. 1B shows the antenna in its folded state. The antenna goes from a dipole antenna (unfolded state; see, e.g., FIG. 3B) to a conical spiral antenna (folded state; see, e.g., FIGS. 4A and 4B).

Figure 4B:
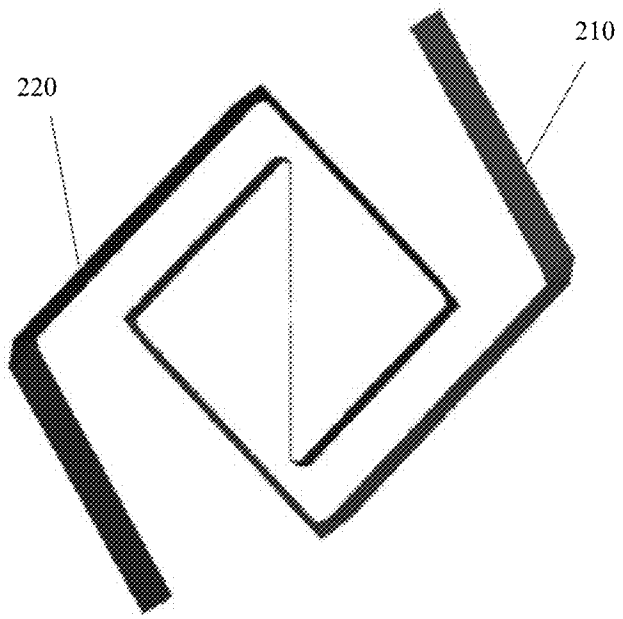
FIG. 4B shows a top view of metal lines of a folded-state antenna according to an embodiment of the subject invention.
Figure 4A:
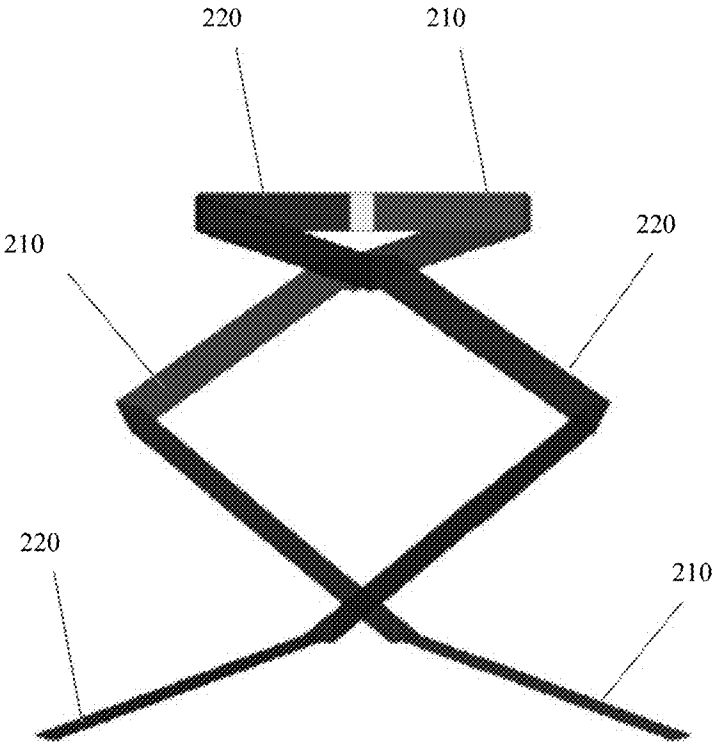
FIG. 4A shows a side view of metal lines of a folded-state antenna according to an embodiment of the subject invention.

The diameter d of the circular base was 195 mm. The lengths of the segments of one arm were as follows: l1=20 mm, l2=26 mm, l3=33 mm, l4=27 mm, and l5=12 mm. The width of each metal line was 3 mm. FIGS. 4A and 4B show a side view and a top view, respectively, of the metal lines of this antenna in the folded state (conical spiral antenna).

Figure 5:
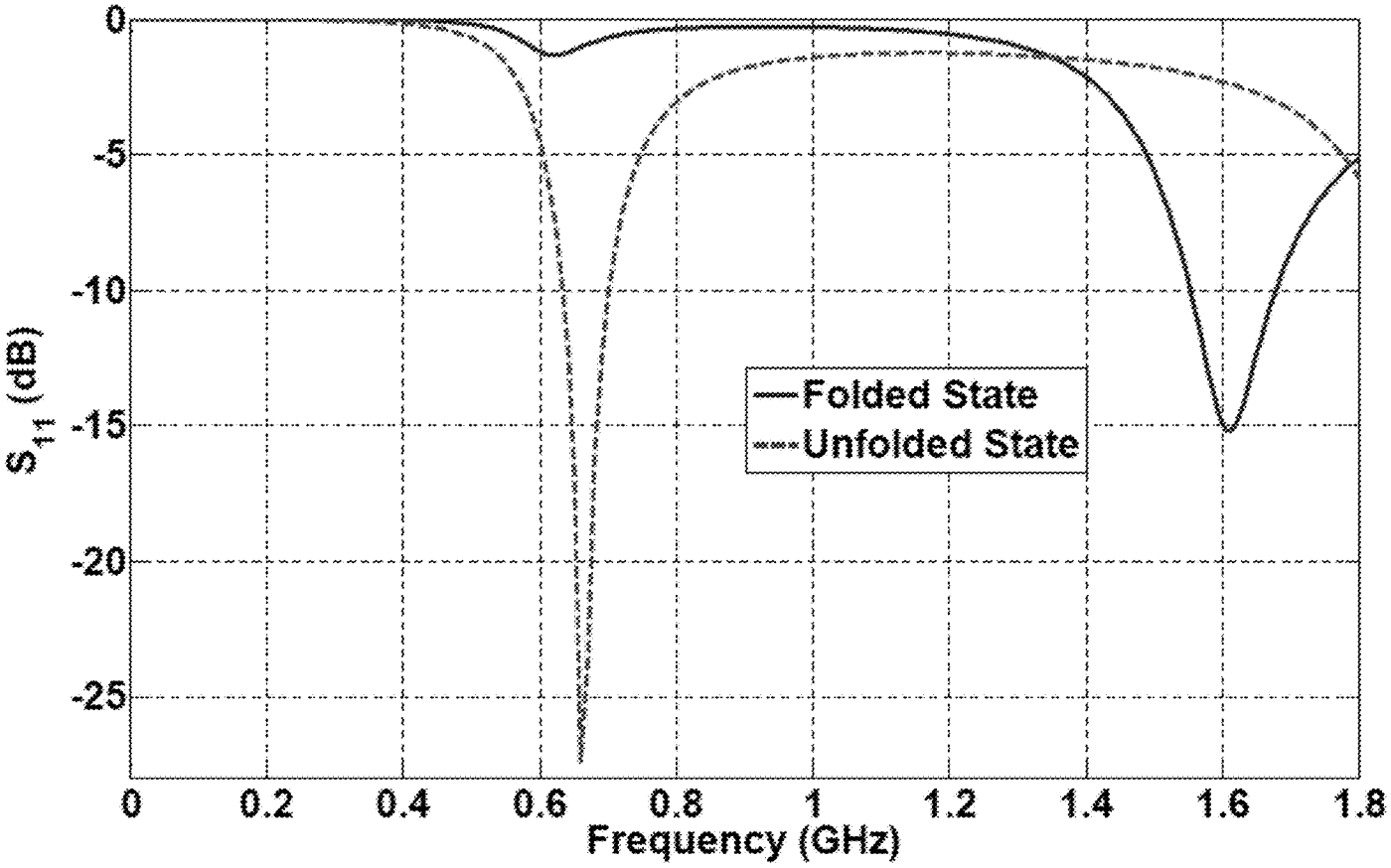
FIG. 5 shows a plot of return loss versus frequency.

Simulations were performed in ANSYS HFSS. The thickness of the paper base, and the thickness of each metal strip were both 0.1 mm. The permittivity of the paper base was 2.2. FIG. 5 shows a plot of the simulated return loss ($S_{11}$, in decibels (dB)) versus frequency (in gigahertz (GHz)) of this antenna at different states. The blue (solid) line shows the return loss for the folded state, and the red (dashed) line shows the return loss for the unfolded state. Referring to FIG. 5, the folded antenna shows the best $S_{11}$ at 1.61 GHz, and the unfolded antenna shows the best $S_{11}$ at 0.66 GHz. Also, the fact that the return loss is below −15 dB shows that this antenna matches well with 50 ohms. FIG. 5 demonstrates that the operating frequency of this origami antenna changes when it folds or unfolds, thereby providing a reconfigurable performance.

Figure 6A:
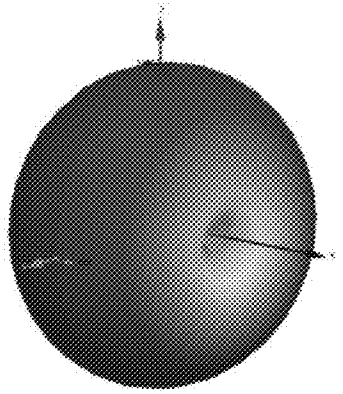
FIG. 6A shows a 3-D realized gain pattern.
Figure 6B:
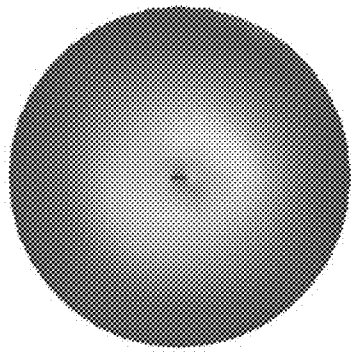
FIG. 6B shows a 3-D realized gain pattern.
Figure 6C:
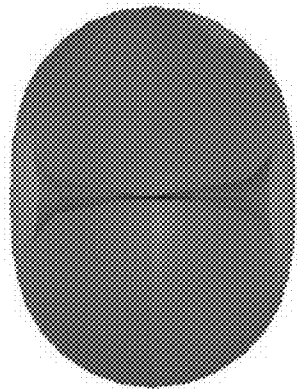
FIG. 6C shows a 3-D realized gain pattern.
Figure 6D:
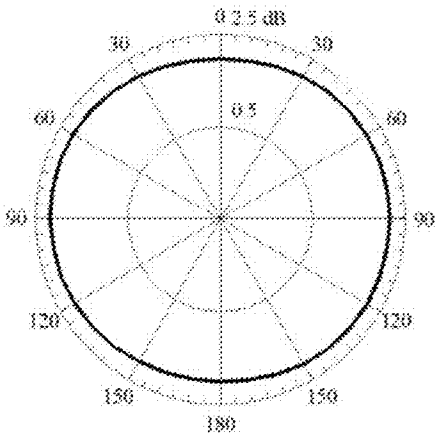
FIG. 6D shows an elevation plane gain pattern.

FIGS. 6A-6C show 3-D realized gain patterns of the antenna at 0.66 GHz in the unfolded state. FIG. 6D shows an elevation plane gain pattern at 0.66 GHz of the antenna in the unfolded state with phi=0°. If the arms of the antenna are put along the y-axis, the maximum realized gain is 2.32 dB, which appears at the xz-plane. Therefore, as expected, this antenna is omnidirectional as a dipole in the unfolded state.

Figure 7A:
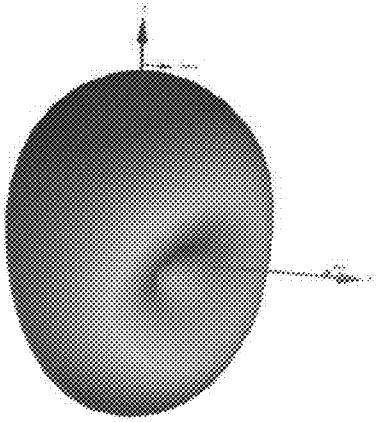
FIG. 7A shows a 3-D realized gain pattern.
Figure 7B:
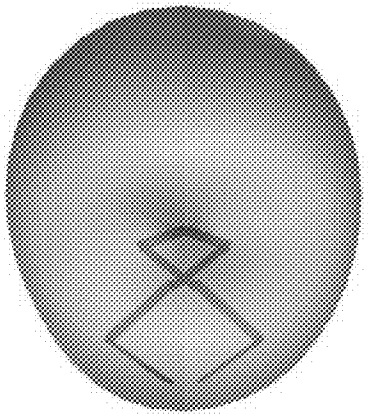
FIG. 7B shows a 3-D realized gain pattern.
Figure 7C:
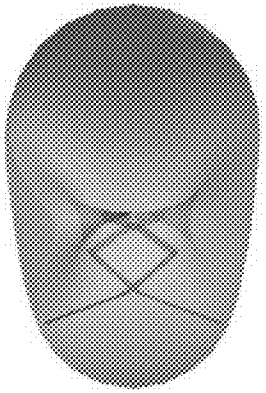
FIG. 7C shows a 3-D realized gain pattern.
Figure 7D:
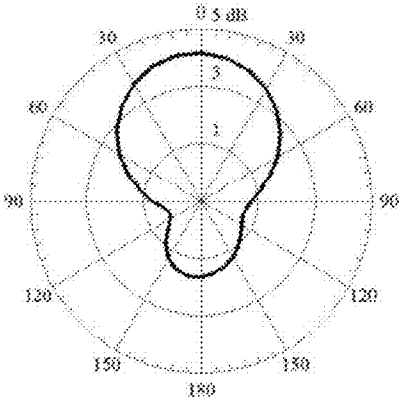
FIG. 7D shows an elevation plane gain pattern.

FIGS. 7A-7C show 3-D realized gain patterns of the antenna at 1.61 GHz in the folded state. FIG. 7D shows an elevation plane gain pattern of the antenna at 1.61 GHz in the folded state with phi=0°. It can be seen that in the folded state, the antenna is directional. The peak realized gain is 4.18 dB, and it is along the z direction. Therefore, this illustrates that this origami antenna radiates differently at the two different operating frequencies (one for the unfolded state and one for the folded state).

The simulation results show that the antenna can advantageously change its operating frequency and radiation pattern, depending on whether it is in the folded or unfolded state.

Example 2

An antenna having four metal lines disposed on a substrate was fabricated. The substrate used was a paper substrate having the markings for folding depicted in FIG. 1A. FIG. 8A shows a top view of the four metal lines, and FIG. 8B shows a top view of the substrate having the metal lines disposed thereon. The substrate was folded along the markings, as depicted in FIG. 2.

FIG. 8C shows a side view of the metal lines when the antenna is in the folded state, and FIG. 8D shows a top view of the metal lines when the antenna is in the folded state. The antenna goes from a 2-dipole antenna (unfolded state; see, e.g., FIG. 8A) to a quadri-conical spiral antenna (folded state; see, e.g., FIGS. 8C and 8D).

Example 3

An antenna having two metal lines disposed on a substrate was fabricated. The substrate used was a paper substrate having the markings for folding depicted in FIG. 9A. The central hub was a hexagon. FIG. 9B shows a top view of the two metal lines. The substrate was folded along the markings, where solid markings indicate mountain folds, and dashed markings indicate valley folds. FIG. 9C shows a top view of the metal lines when the antenna is in the folded state, and FIG. 9D shows a schematic view of the antenna in the folded state. The metal lines are omitted from the schematic view in FIG. 9D. The antenna goes from a dipole antenna (unfolded state; see, e.g., FIG. 9B) to a spiral antenna (folded state; see, e.g., FIG. 9C).

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein (including those in the "References" section) are incorporated by reference in their entirety, including all figures and tables, to the extent they are not inconsistent with the explicit teachings of this specification.

REFERENCES

[1] S. Yao, S. V. Georgakopoulos, B. Cook and M. M. Tentzeris, "A novel reconfigurable origami accordion antenna," *IEEE International Microwave Symposium,* Tampa Bay, Fla., Jun. 1-6, 2014.

[2] X. Liu, S. Yao, S. V. Georgakopoulos, B. Cook and M. M. Tentzeris, "Reconfigurable helical antenna based on an origami structure for wireless communication system," *IEEE International Microwave Symposium*, Tampa Bay, Fla., Jun. 1-6, 2014.

[3] S. Yao, X. Liu, S. V. Georgakopoulos and M. M. Tentzeris, "A novel reconfigurable origami spring antenna," *IEEE International Symposium on Antennas and Propagation*, pp. 374-375, TN, Jul. 6-11, 2014.

[4] S. Yao, X. Liu, S. V. Georgakopoulos and M. M. Tentzeris, "A novel tunable origami accordion antenna," *IEEE International Symposium on Antennas and Propagation,* pp. 370-371, TN, Jul. 6-11, 2014.

[5] T. Nojima, "Origami Modeling of Functional Structures based on Organic Patterns," Kyoto University.

What is claimed is:

1. An antenna, comprising:

a substrate having a rigid central hub and folding markings provided on the substrate outside the rigid central hub; and at least one metal line disposed on the substrate, the antenna having an unfolded state and a folded state resulting from folding the substrate based on the folding markings, at least one radiation characteristic of the antenna being different in the folded state than it is in the unfolded state, the at least one radiation characteristic being radiation pattern, bandwidth, beamwidth, operating frequency, or directivity, and the at least one metal line being configured to be a dipole antenna in the unfolded state and a conical spiral antenna in the folded state.

2. The antenna according to claim 1, wherein the at least one radiation characteristic includes at least one of operating frequency and directivity.

3. The antenna according to claim 1, wherein at least two radiation characteristics of the antenna are different in the folded state than they are in the unfolded state.

4. The antenna according to claim 1, wherein at least three radiation characteristics of the antenna are different in the folded state than they are in the unfolded state.

5. The antenna according to claim 1, wherein at least four radiation characteristics of the antenna are different in the folded state than they are in the unfolded state.

6. The antenna according to claim 1, wherein the radiation pattern, bandwidth, beamwidth, operating frequency, and directivity of the antenna are all different in the folded state than they are in the unfolded state.

7. The antenna according to claim 1, comprising at least two metal lines disposed on the substrate.

8. The antenna according to claim 1, wherein the substrate comprises at least one of a paper material, a cardboard material, or Kapton®.

9. The antenna according to claim 1, wherein the substrate is circular.

10. The antenna according to claim 1, wherein the rigid central hub of the substrate has a polygon shape.

11. The antenna according to claim 10, wherein the folding markings are Archimedean spiral lines.

12. A method of using an antenna for wireless communication, the method comprising:

providing the antenna according to claim 1;

using the antenna for its intended purpose; and changing the state of the antenna from the folded state to the unfolded state, or from the unfolded state to the folded state, such that the at least one radiation characteristic of the antenna changes.

13. A method of fabricating an antenna, the method comprising:

forming a substrate;

providing a rigid central hub on the substrate;

providing folding markings outside the rigid central hub on the substrate, the folding markings including lines extending away from respective corners of the rigid central hub, and each line extending away from a respective corner of the rigid central hub extends towards a respective edge of the substrate; and disposing at least one metal line on the substrate.

14. The method according to claim 13, wherein the substrate comprises at least one of a paper material or a cardboard material.

15. The method according to claim 13, wherein the substrate is circular.

16. The method according to claim 13, wherein the rigid central hub of the substrate has a polygon shape, and wherein the folding markings are Archimedean spiral lines.

17. A method of fabricating an antenna, the method comprising:

forming a substrate;

providing a rigid central hub on the substrate;

providing folding markings outside the rigid central hub on the substrate; and disposing at least one metal line on the substrate, the rigid central hub of the substrate having a polygon shape, the folding markings being Archimedean spiral lines, the folding markings including first lines intended for mountain-style folds and second lines intended for valley-style folds, the folding markings further including lines extending away from respective corners of the rigid central hub, and each line that extends away from a respective corner of the rigid central hub extending towards a respective edge of the substrate.

18. An antenna, comprising:

a substrate having a rigid central hub and folding markings provided on the substrate outside the rigid central hub; and at least one metal line disposed on the substrate, the antenna having an unfolded state and a folded state resulting from folding the substrate based on the folding markings, at least one radiation characteristic of the antenna being different in the folded state than it is in the unfolded state, the at least one radiation characteristic being radiation pattern, bandwidth, beamwidth, operating frequency, or directivity, the rigid central hub of the substrate having a polygon shape, the folding markings being Archimedean spiral lines, and the folding markings including solid lines intended for mountain-style folds and dashed lines intended for valley-style folds.

19. An antenna, comprising:

a substrate having a rigid central hub and folding markings provided on the substrate outside the rigid central hub; and at least one metal line disposed on the substrate, the antenna having an unfolded state and a folded state resulting from folding the substrate based on the folding markings, at least one radiation characteristic of the antenna being different in the folded state than it is in the unfolded state, the at least one radiation characteristic being radiation pattern, bandwidth, beamwidth, operating frequency, or directivity, the folding markings including lines extending away from respective corners of the rigid central hub, and each line that extends away from a respective corner of the rigid central hub extending towards a respective edge of the substrate.

20. An antenna, comprising:

a substrate having a rigid central hub and folding markings provided on the substrate outside the rigid central hub; and at least one metal line disposed on the substrate, the antenna having an unfolded state and a folded state resulting from folding the substrate based on the folding markings, at least one radiation characteristic of the antenna being different in the folded state than it is in the unfolded state, the at least one radiation characteristic being radiation pattern, bandwidth, beamwidth, operating frequency, or directivity, the at least one radiation characteristic including at least one of operating frequency and directivity, the substrate being circular, the rigid central hub of the substrate having a polygon shape, the folding markings being Archimedean spiral lines, the folding markings including first lines intended for mountain-style folds and second lines intended for valley-style folds, the folding markings further including lines extending away from respective corners of the rigid central hub, and each line that extends away from a respective corner of the rigid central hub extending towards a respective edge of the substrate.

* * * * *